US007891595B2

(12) United States Patent
Kaja

(10) Patent No.: US 7,891,595 B2
(45) Date of Patent: Feb. 22, 2011

(54) NO-LOAD BEARING FOR A CONE CRUSHER

(75) Inventor: Dean M. Kaja, Milwaukee, WI (US)

(73) Assignee: Metso Minerals Industries, Inc., Waukesha, WI (US)

( * ) Notice: Subject to any disclaimer, the term of this patent is extended or adjusted under 35 U.S.C. 154(b) by 230 days.

(21) Appl. No.: 12/362,669

(22) Filed: Jan. 30, 2009

(65) Prior Publication Data

US 2010/0193621 A1 Aug. 5, 2010

(51) Int. Cl.
*B02C 15/10* (2006.01)
*B02C 17/08* (2006.01)

(52) U.S. Cl. ..... 241/207; 241/209; 241/215

(58) Field of Classification Search ..... 241/207–216, 241/286

See application file for complete search history.

(56) References Cited

U.S. PATENT DOCUMENTS 4,750,681 A 6/1988 Sawant et al.
6,315,225 B1 11/2001 Karra
6,513,738 B1 2/2003 Braun et al.
6,648,255 B2 11/2003 Martinez, Jr. et al.
6,877,682 B2 4/2005 Nieminen et al.
6,981,665 B2 1/2006 Braun et al.
7,216,823 B2 5/2007 Delille
2003/0183706 A1 * 10/2003 Cheng ..... 241/46.06
2004/0035967 A1 * 2/2004 Johnson et al. ..... 241/207

OTHER PUBLICATIONS

"Nordberg MP® Series Cone Crushers", METSO Minerals, Brochure No. 1219-01-02-CS, 2002.

* cited by examiner

*Primary Examiner*—Bena Miller
(74) *Attorney, Agent, or Firm*—Andrus, Sceales, Starke & Sawall, LLP

(57) ABSTRACT

A cone crusher includes a stationary main shaft and an eccentric that rotates about the main shaft to cause gyrational movement of a head assembly to crush rock within a crushing gap. The cone crusher includes a lower head bushing in contact with an outer surface of the eccentric. The eccentric is formed with a contact pad to enhance the contact between the eccentric and the lower head bushing during a no-load condition. The contact pad includes a contact surface that is recessed from the outer surface of the eccentric to enhance contact during no-load conditions while maintaining full contact between the lower head bushing and the eccentric outer surface during full load, crushing conditions.

11 Claims, 8 Drawing Sheets

FIG. 10
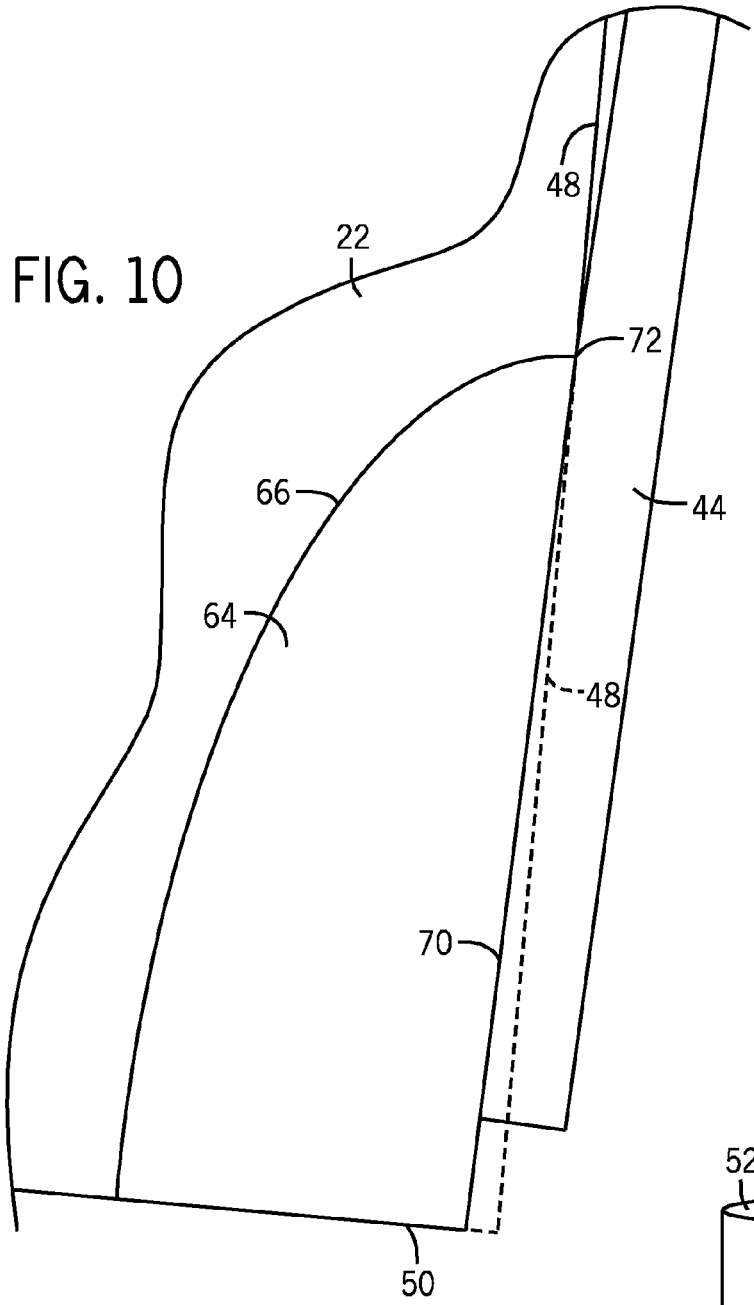
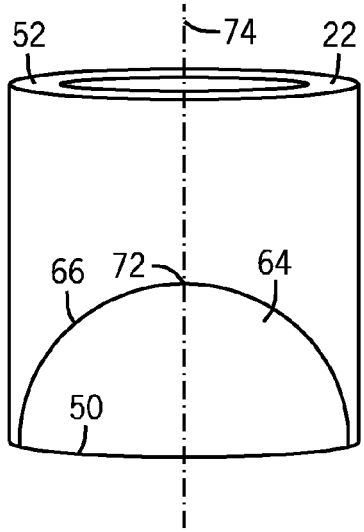
FIG. 11

NO-LOAD BEARING FOR A CONE CRUSHER

BACKGROUND

The present disclosure generally relates to rock crushing equipment. More specifically, the present disclosure relates to a cone crusher including a bearing arrangement that allows for increased contact between the eccentric and lower head bushing during no-load conditions.

Rock crushing systems, such as those referred to as cone crushers, generally break apart rock, stone or other material in a crushing gap between two moving elements. For example, a conical rock crusher is comprised of a head assembly including a crushing head that gyrates about a vertical axis within a stationary bowl attached to a main frame of the rock crusher. The crushing head is assembled surrounding an eccentric that rotates about a fixed shaft to impart the gyrational motion of the crushing head which crushes rock, stone or other material in a crushing gap between the crushing head and the bowl. The eccentric can be driven by a variety of power drives, such as an attached gear, driven by a pinion and countershaft assembly, and a number of mechanical power sources, such as electrical motors or combustion engines.

The exterior of the conical crushing head is covered with a protective or wear-resistant mantle that engages the material that is being crushed, such as rock, stone, or minerals or other substances. The bowl which is mechanically fixed to the mainframe is fitted with a bowl liner. The bowl liner and bowl are stationary and spaced from the crushing head. The bowl liner provides an opposing surface from the mantle for crushing the material. The material is crushed in the crushing gap between the mantle and the bowl liner.

The gyrational motion of the crushing head with respect to the stationary bowl crushes, rock, stone or other material within the crushing gap. Generally, the rock, stone or other material is fed onto a feed plate that directs the material toward the crushing gap where the material is crushed as it travels through the crushing gap. The crushed material exits the cone crusher through the bottom of the crushing gap. The size of the crushing gap determines the maximum size of the crushed material that exist the crushing gap.

Cone crushers are generally designed to operate in a crushing mode where the crushing forces are supported by a bearing system. When the cone crusher is operated without rock or other material, referred to as no-load operation, the centrifugal forces created by the moving head assembly results in a completely different area of contact within the bearing system.

In addition to the no-load operating conditions, there are also instances in which the cone crusher is operated either with relatively small crushing forces due to a small quantity of rock entering the crushing chamber or with an offset load. During this reduced-load condition, the centrifugal forces of the head are greater than the crushing forces generated by crushing of the small quantity of feed rock. During the reduced-load condition, the bearing system will see a situation that can create uneven bearing alignment and may result in impact loading as the bushings are constantly realigned and misaligned by the changing rock forces.

During these no-load and reduced-load conditions, a loss of oil film between the bushing and the eccentric can be created. This loss of oil film can result in overheating or burning of the bushing during operation. This is a costly situation because the burning of the bushing and possibly other associated components may require the replacement of these components, resulting in the cost of the components, the cost of performing the unplanned maintenance and the lack of production resulting from the unavailability of the cone crusher.

SUMMARY

The present disclosure generally relates to a bearing arrangement for use in a cone crusher. The bearing arrangement includes an eccentric that rotates about a fixed main shaft in the cone crusher. The eccentric includes a generally cylindrical inner surface and a generally cylindrical outer surface. A lower head bushing is positioned to surround the eccentric and is spaced from the outer surface of the eccentric. The lower head bushing includes an inner surface that is cylindrical and contacts the outer surface of the eccentric during crushing of the material within the cone crusher.

The eccentric includes a contact pad that is formed along a portion of the outer surface of the eccentric. The contact pad includes a contact surface that is recessed from the outer surface of the eccentric such that the lower head bushing engages the contact pad during operation of the cone crusher without material. When the cone crusher is operated with material in the crushing gap, the contact pad is spaced from the lower head bushing while the opposite side of the lower head bushing engages the outer surface of the eccentric.

In an embodiment of the disclosure, the contact pad extends from a first end of the eccentric to a termination point that is spaced from the second end of the eccentric. The contact pad includes a contact surface that is recessed from the outer surface of the eccentric. The recessed depth of the contact surface from the outer surface of the eccentric increases from the termination point to the first end of the eccentric.

The disclosure further relates to a cone crusher having a frame, a bowl coupled to the frame, a head assembly movable relative to the frame and defining a crushing gap between the head assembly and the bowl. The cone crusher further includes a bearing assembly that includes an eccentric and a lower head bushing. The eccentric rotates about a fixed main shaft while the lower head bushing is spaced slightly from the eccentric. During operation of the cone crusher to crush material, the lower head bushing contacts the outer surface of the eccentric. When the cone crusher is operated either without any material or with a small or offset load, the head assembly pivots slightly such that the lower head bushing tilts relative to the eccentric. A contact pad is formed in the outer surface of the eccentric such that when the cone crusher is operated in a no-load or small load condition, the lower head bushing engages the contact surface of the contact pad.

In one embodiment of the disclosure, the contact pad extends from the first end of the eccentric to a termination point spaced from a second end of the eccentric. The contact surface of the contact pad is recessed further from the outer cylindrical surface of the eccentric from the termination point to the first end of the eccentric.

BRIEF DESCRIPTION OF THE DRAWINGS

The drawings illustrate the best mode presently contemplated of carrying out the disclosure. In the drawings:

FIG. 10 is a magnified view of the area shown by line 10-10 in FIG. 9 illustrating the contact between the lower head bushing and the contact pad formed on the eccentric;

FIG. 11 is a front view of the eccentric illustrating the position of the contact pad along a line of symmetry of the eccentric;

DETAILED DESCRIPTION

Figure 1:
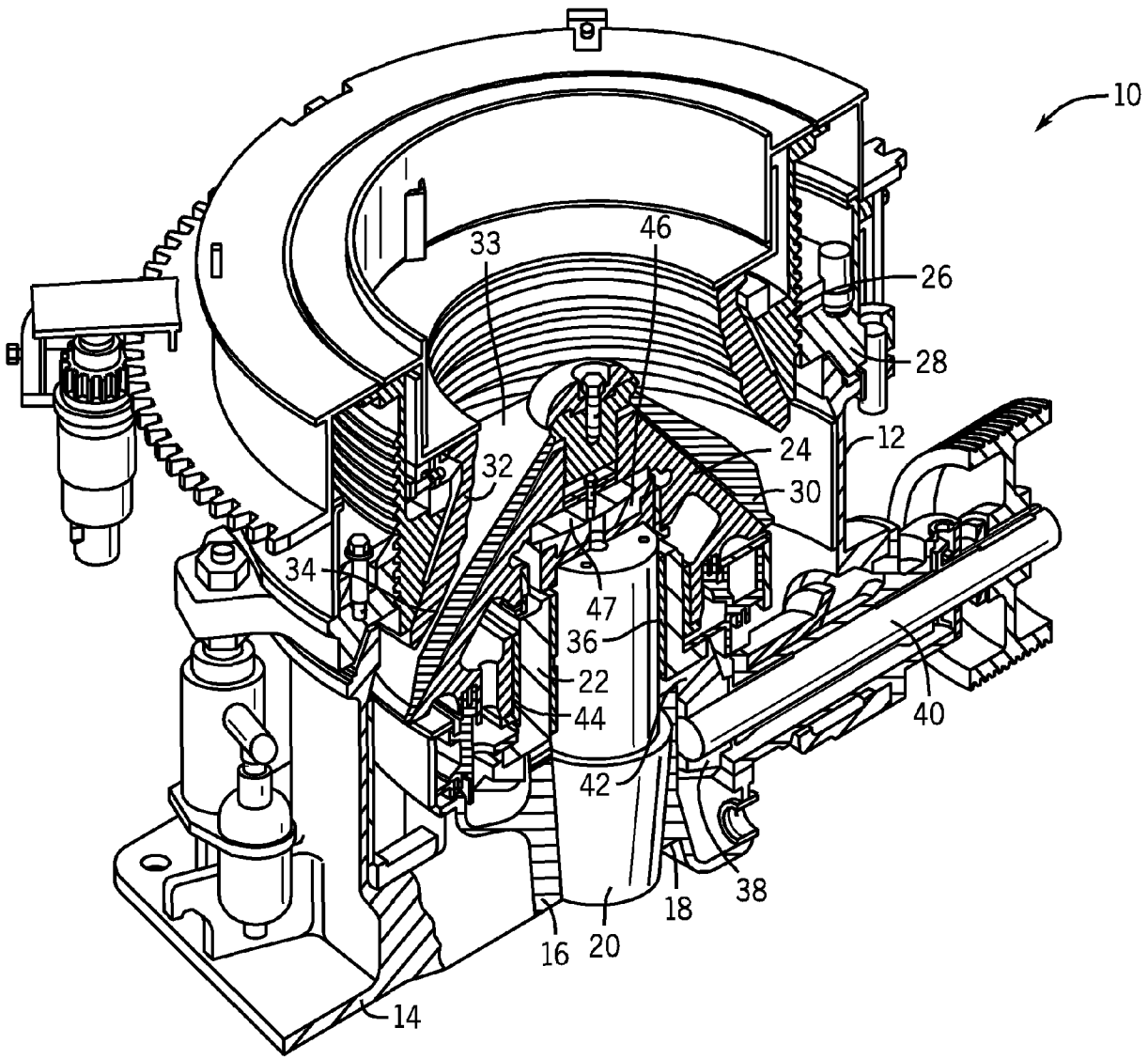
FIG. 1 is a perspective view, in partial cutaway, of a cone crusher including the bearing arrangement of the present disclosure.

FIG. 1 illustrates a cone crusher 10 that is operable to crush material, such as rock, stone, ore, mineral or other substances. The cone crusher 10 includes a mainframe 12 having a base 14. The cone crusher 10 can be any size rock crusher or include any size of crusher head, such as a short head or a standard head. Base 14 rests upon a platform-like foundation that can include concrete piers (not shown), a foundation block, a platform or other supporting member. A central hub 16 of the mainframe 12 includes an upwardly diverging vertical bore or tapered bore 18. The bore 18 is adapted to receive a main shaft 20. The main shaft 20 is held stationary in the bore 18 with respect to the central hub 16 of the frame 12.

The main shaft 20 supports an eccentric 22 that surrounds the main shaft 20 and is coupled to a head assembly 24. The eccentric 22 rotates about the stationary main shaft 20, thereby causing the head assembly 24 to gyrate within the cone crusher 10. Gyration of the head assembly 24 within a bowl 26 that is fixed to an adjustment ring 28 connected to the mainframe 12 allows rock, stone, ore, minerals or other materials to be crushed between a mantle 30 and a bowl liner 32. The head assembly 24 includes a feed plate 33 that directs materials toward a crushing gap 34. The bowl liner 32 is held against the bowl 26 and the mantle 30 is attached to the head assembly 24. The head assembly 24 forces the mantle 30 toward the bowl liner 32 to create the rock crushing force within the crushing gap 34.

As illustrated in FIG. 1, an eccentric bushing 36 is located between the stationary main shaft 20 and the rotating eccentric 22. The eccentric 22 and the eccentric bushing 36 rotate about the stationary main shaft 20 through the interaction between a pinion 38 contained on the drive shaft 40 and a gear 42 mounted to the lower end of the eccentric 24. A supply of lubricating oil passes through the center of the stationary main shaft 20 to provide lubrication between the eccentric bushing 36 and the stationary main shaft 20.

A lower head bushing 44 is positioned between the outer surface of the eccentric 22 and the lower portion of the head assembly 24. A lubricant is received between the lower head bushing 44 and the eccentric 22 to lubricate the area of contact between the rotating eccentric 22 and the non-rotating head assembly 24.

As can be understood in FIG. 1, when the cone crusher 10 is operating, drive shaft 40 rotates the eccentric 22 through the interaction between the pinion 38 and the gear 42. Since the outside diameter of the eccentric 22 is offset from the inside diameter, the rotation of the eccentric 22 creates the gyrational movement of the head assembly within the stationary bowl 26. The gyrational movement of the head assembly 24 changes the size of the crushing gap 34 which allows the material to be crushed to enter into the crushing gap. Further rotation of the eccentric 22 creates the crushing force within the crushing gap 34 to reduce the size of particles being crushed by the cone crusher 10. The cone crusher 10 can be one of many different types of cone crushers available from various manufacturers, such as Metso Minerals of Milwaukee, Wis. As an example, the cone crusher 10 shown in FIG. 1 can be an MP® series rock crusher, such as the MPOR®1000 available from Metso Minerals. However, different types of cone crushers could be utilized while operating within the scope of the present disclosure.

During operation of the cone crusher 10 with materials being crushed, the crushing force created in the crushing gap 34 exerts a force against the mantle 30 of the head assembly 24. This force causes the head assembly 24 to shift about the pivoting connection created by the socket liner 46 and the head ball 47. This pivoting movement causes the lower head bushing 44 to engage the eccentric 22 in a manner to be described in greater detail below.

Alternatively, when the cone crusher 10 is operating without any material being crushed, the centrifugal force of the head assembly 24 created by the gyrating motion of the head assembly 24 caused by the rotating eccentric 22 causes the head assembly 24 to pivot in an opposite direction about the socket liner 46, which creates different points of contact between the lower head bushing 44 and the eccentric 22. Further details of this contact during a no-load condition will also be described in detail below.

Figure 2:
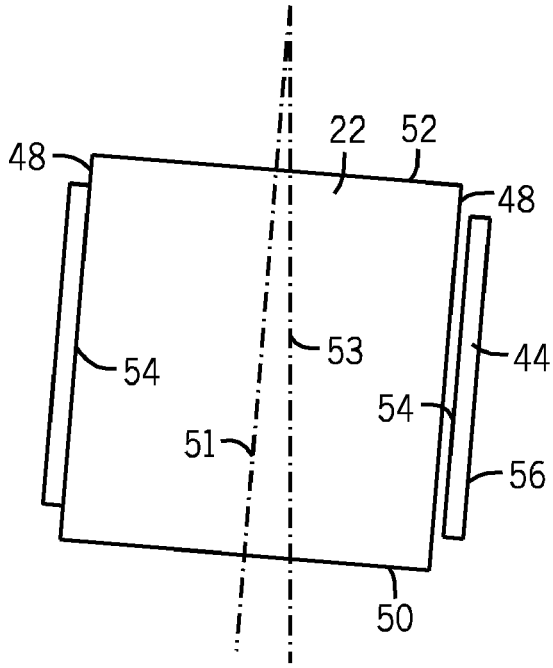
FIG. 2 PRIOR ART
FIG. 2 is a schematic illustration of the interaction between the eccentric and lower head bushing in a prior art cone crusher under loaded conditions.
Figure 3:
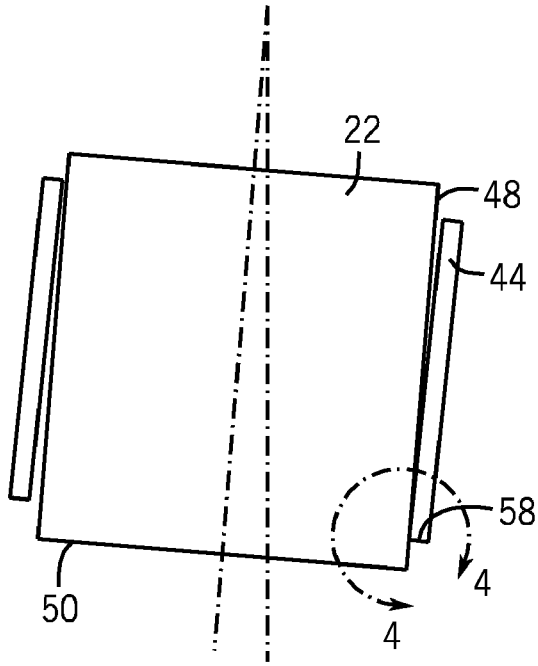
FIG. 3 PRIOR ART
FIG. 3 is a schematic illustration similar to FIG. 2 illustrating the interaction between the eccentric and lower head bushing during a no-load condition.

FIGS. 2 and 3 illustrate a prior art configuration of the eccentric 22 and the lower head bushing 44. The size and spacing between the eccentric 22 and the lower head bushing 44 are exaggerated in FIGS. 2 and 3 to illustrate the interaction between the eccentric 22 and the lower head bushing. In the prior art embodiment shown in FIGS. 2 and 3, the eccentric 22 includes a cylindrical outer surface 48 that extends from a first end 50 to a second end 52. The outside diameter of the eccentric 22 is centered along a main axis 51 that is offset from the vertical axis 53. This offset helps to create the gyrational movement of the head assembly in the cone crusher. The lower head bushing 44 is also a cylindrical member having a center axis slightly offset and parallel to the main axis 51. The lower head bushing 44 includes a purely cylindrical inner surface 54 and a purely cylindrical outer surface 56.

When the cone crusher is operating to crush material contained within the cone crusher, the crushing forces within the cone crusher pivot the crusher head assembly such that the inner surface 54 of the lower head bushing 44 engages the outer surface 48 of the eccentric along the entire length of one side of the entire lower head bushing 44, as shown in FIG. 2.

In this loaded condition, the lubrication included in the lower head bushing 44 lubricates the entire surface of the eccentric 22 in the load carrying zone.

FIG. 3 illustrates a condition for the cone crusher in which either no material is being crushed or only a small quantity of particles are being crushed by the cone crusher. In this condition, the clearance between the lower head bushing 44 and the outer surface 48 of the eccentric 22 results in the head assembly pivoting about the socket liner 46 in the manner shown in FIG. 3. In this condition, the lower head bushing 44 is no longer aligned with the outer surface 48 of the eccentric 22. Instead, a lower corner 58 of the lower head bushing 44 creates a small point of contact with the outer surface 48 of the eccentric near the first end 50.

Figure 4:
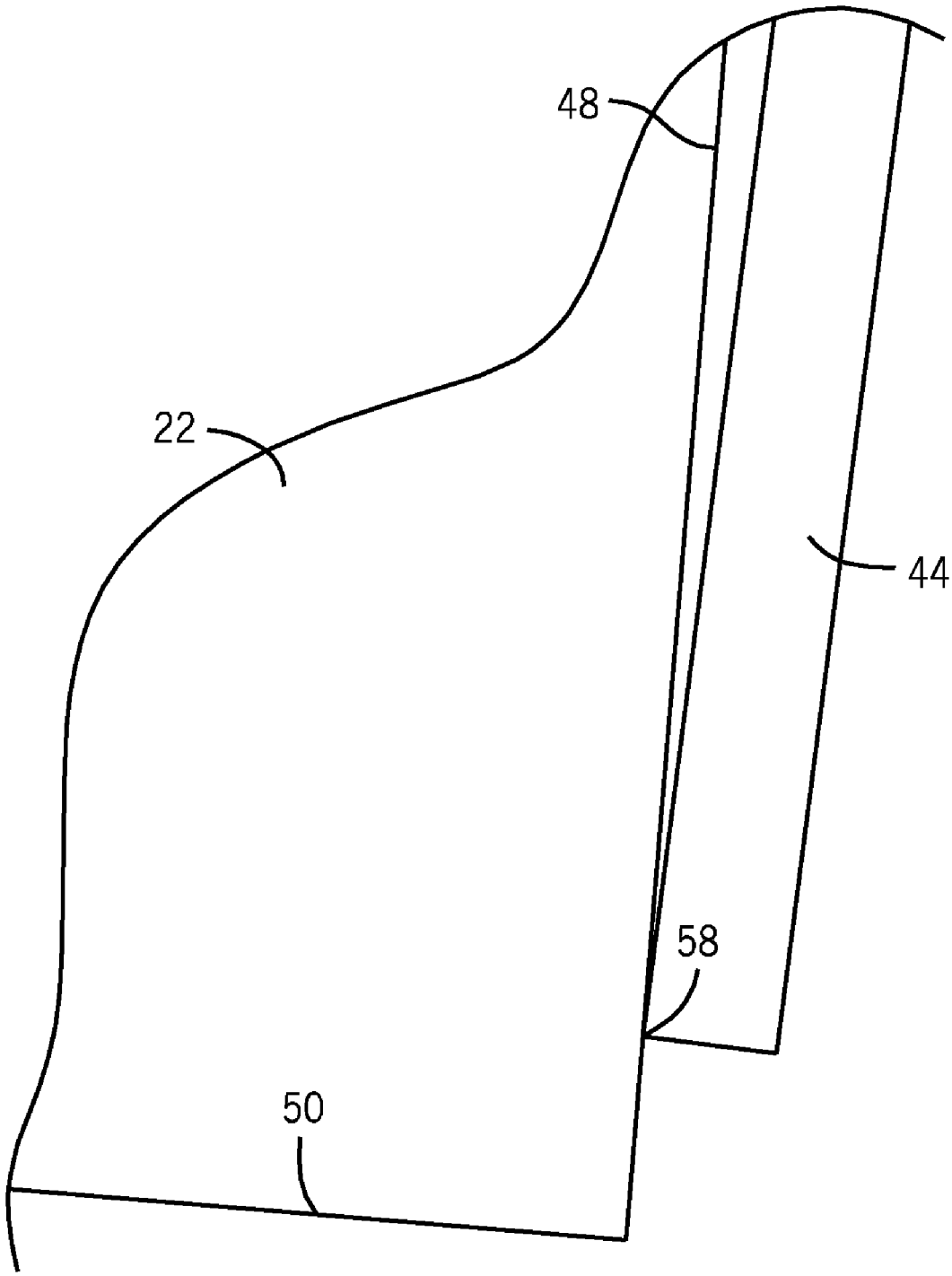
FIG. 4 is a magnified view taken along line 4-4 of FIG. 3 showing the interaction between the lower head bushing and the eccentric.

The magnified view of FIG. 4 has been exaggerated to illustrate the relatively small point of contact between the lower corner 58 and the outer surface 48 of the eccentric 22. The small point of contact between the cylindrical outer surface 48 of the eccentric 22 and the lower corner 58 of the lower head bushing 44 creates a high local contact pressure when the lower head bushing 44 is new. After a break-in period, the lower corner 58 wears to create a slight taper at the bottom of the lower head bushing 44. However, during the initial use of the cone crusher having a new lower head bushing 44, the high contact pressure between the corner 58 and the outer surface 48 can create operational problems.

As a specific example, when the cone crusher is operated with either small loads or offset loads before the break-in period is complete, the eccentric 22 and the lower head bushing 44 may oscillate between the two conditions shown in FIGS. 2 and 3. During such oscillation, the point contact between the corner 58 and the eccentric 22 may be sufficient to break through the oil film between the bushing 44 and the eccentric 22, creating metal-on-metal contact. This metal-on-metal contact creates heat and can damage either the bushing 44 or the eccentric 22 before the bushing becomes worn.

Figure 5:
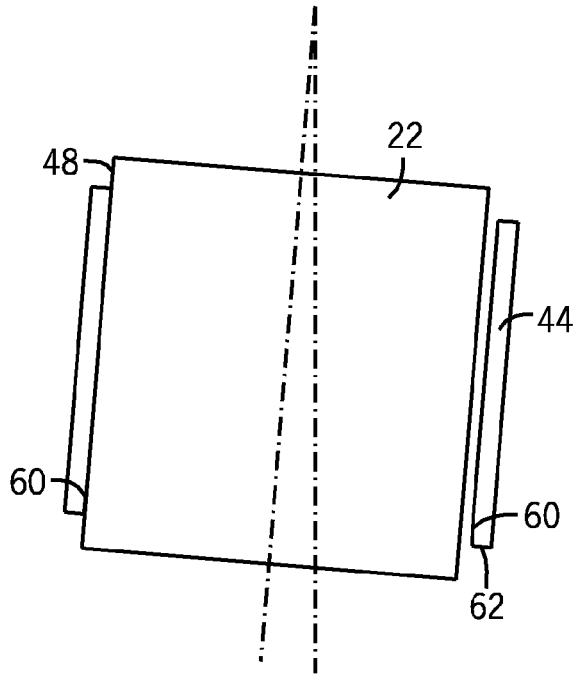
FIG. 5 PRIOR ART
FIG. 5 is a schematic illustration of a prior art system having a tapered section formed along the lower end of the lower head bushing in a loaded condition.
Figure 6:
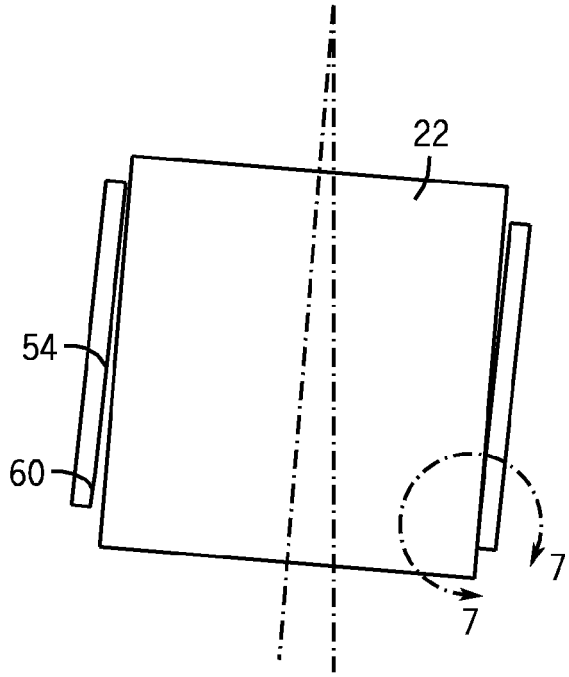
FIG. 6 PRIOR ART
FIG. 6 is a view similar to FIG. 5 illustrating the interaction between the eccentric and the lower head bushing in a no-load condition.
Figure 7:
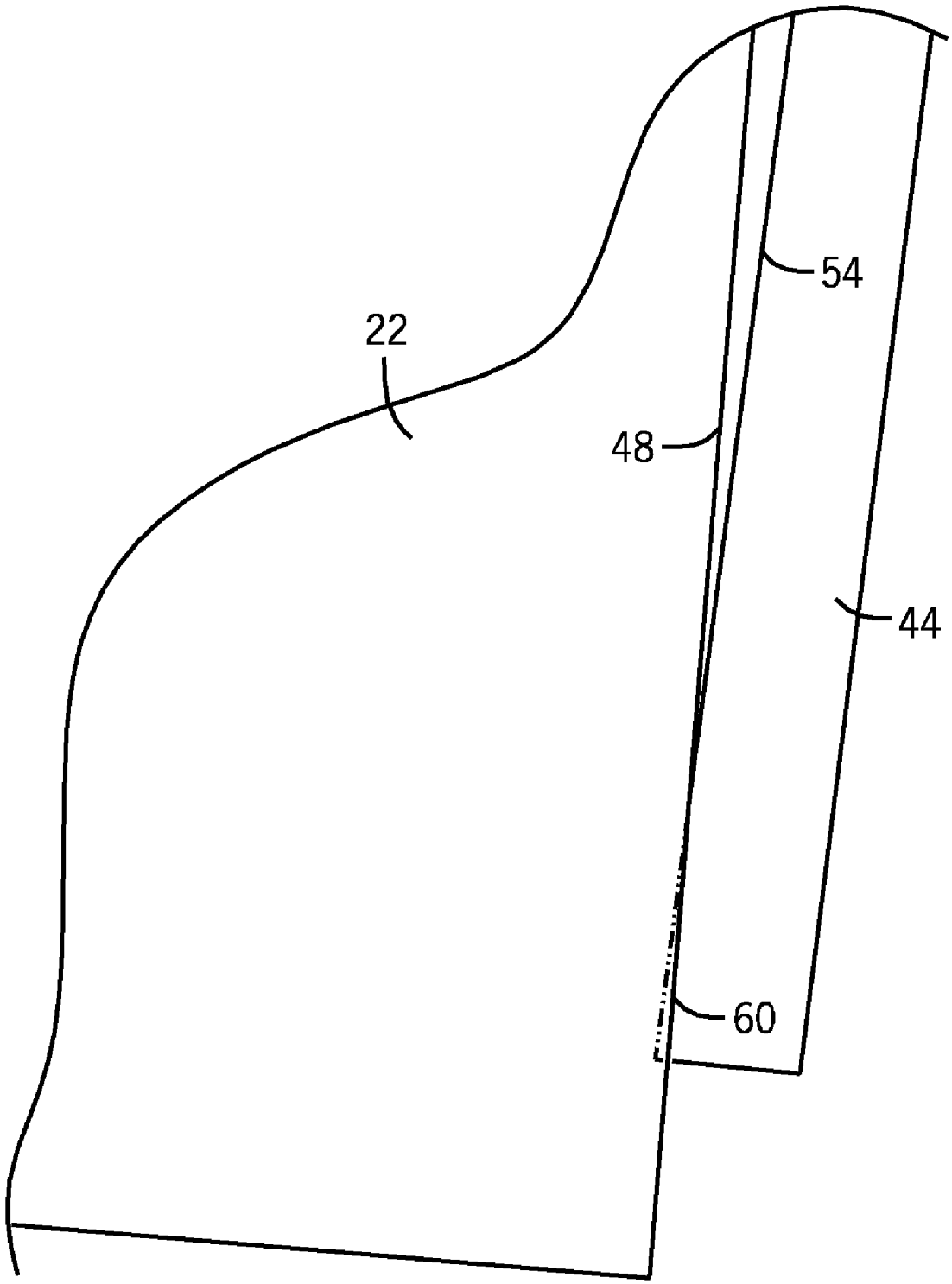
FIG. 7 is a magnified view taken along line 7-7 of FIG. 6 illustrating the interaction between the tapered section of the lower head bushing and the eccentric.

To make the break-in period shorter relative to the embodiment shown in FIGS. 2-4, an enhanced configuration for the eccentric 22 and the lower head bushing 44 was developed, as illustrated in FIGS. 5-7. In the prior art embodiment shown in FIG. 7, the lower head bushing 44 is designed with a slight tapered section 60 recessed from the otherwise constant diameter inner surface 54, as shown by the dashed lines of FIG. 7. As illustrated in FIG. 6, the tapered section 60 is formed along the first end 62 of the lower head bushing 44. The tapered section 60 extends around the entire circumference of the inner surface 54. As illustrated in FIGS. 6 and 7, when the cone crusher is being operated in either a no-load or small load condition, the tapered section 60 formed on the inner surface 54 increases the area of contact between the lower head bushing 44 and the outer surface 48 of the eccentric 22. The tapered section 60 thus replicates the lower head bushing 44 of FIG. 4 after the break-in period.

Although the tapered section 60 improves the no-load contact between the lower head bushing 44 and the eccentric 22, the tapered section 60 does not contact the outer surface 48 of the eccentric 22 in the loaded condition of FIG. 5. Since the cone crusher will primarily be operated in the loaded condition of FIG. 5, the size of the tapered section 60 is limited in order to provide enough surface contact area between the lower head bushing 44 and the eccentric mechanism 22 during the crushing mode. In the prior art embodiment shown in FIGS. 5-7, the tapered section 60 is at most approximately 12% of the entire length of the entire lower head bushing 44. Thus, although the tapered section 60 functions well during the no-load condition, the tapered section 60 reduces the effective contact surface of the lower head bushing 44 during the crushing operation.

Figure 8:
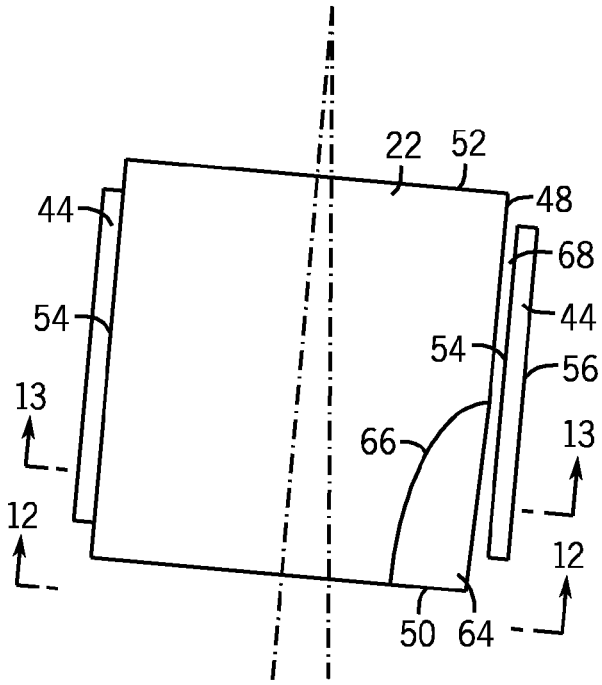
FIG. 8 is a schematic illustration of the bearing arrangement of the present disclosure illustrating a contact pad formed on the eccentric in a loaded condition.
Figure 9:
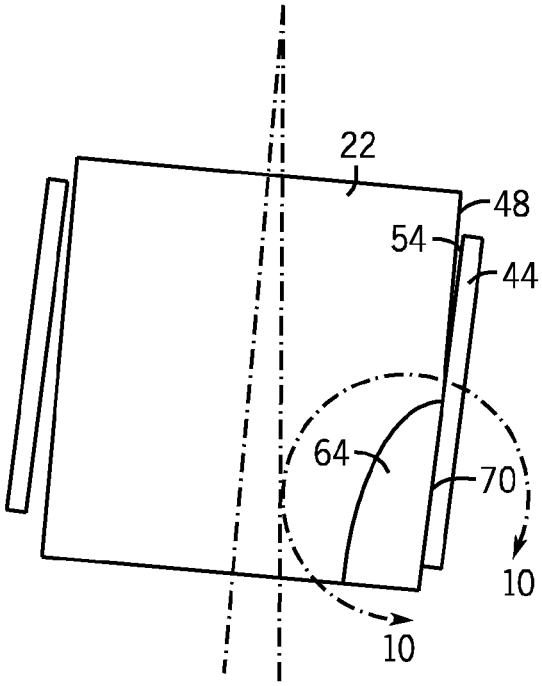
FIG. 9 is a view similar to FIG. 8 illustrating the interaction between the contact pad on the eccentric and the lower head bushing during a no-load condition.

Referring now to FIGS. 8-10, thereshown is an embodiment of the bearing arrangement in accordance with the present disclosure. In the embodiment shown in FIG. 8, the eccentric 22 includes the generally cylindrical outer surface 48 that extends from the first end 50 to the second end 52. The eccentric 22 is utilized with the lower head bushing 44. In the embodiment illustrated, the lower head bushing 44 is similar to the lower head bushing shown in FIG. 2, namely, the lower head bushing includes a purely cylindrical outer surface 56 and a purely cylindrical inner surface 54. In the embodiment shown in FIG. 8, the lower head bushing 44 does not include the tapered section 60 shown in FIGS. 6 and 7.

The eccentric 20 shown in FIG. 8 includes a contact pad 64 that is recessed from the otherwise cylindrical outer surface 48. The contact pad 64 is preferably machined from the otherwise cylindrical outer surface 48 and is defined by an edge surface 66. In one embodiment of the disclosure, the contact pad 64 is machined as a cylindrical surface such that the edge surface 66 is elliptical, nearly approaching a semi-circle.

During operation in the crushing mode shown in FIG. 8, the region of the outer surface 48 of the eccentric 22 that does not include the contact pad 64 creates a continuous region of contact with the inner surface 54 of the lower head bushing 44. In the crushing mode shown in FIG. 8, a slight space 68 exits between the lower head bushing 44 and the outer surface 48 of the eccentric 22. Since the contact pad 64 is formed on only the non-contact portion of the eccentric 22, the inclusion of the contact pad 64 on the eccentric 22 does not affect the interaction between the lower head bushing 44 and the eccentric 22 in the crushing mode.

In the no-load condition shown in FIGS. 9 and 10, the cylindrical inner surface 54 of the lower head bushing 44 engages the contact surface 70 of the contact pad 64. In this condition, the contact pad 64 increases the surface contact area between the lower head bushing 44 and the eccentric 22. The use of the contact pad 64 is thus an improvement over the prior art system in which a taper was included on the lower head bushing 44. Specifically, the use of the contact pad 64 does not reduce the surface contact between the lower head bushing 44 and the eccentric 22 in the crushing mode shown in FIG. 8 while at the same time increasing the area of contact between the lower head bushing 44 and the eccentric during the no-load condition of FIG. 9.

Referring now to FIG. 10, the contact surface 70 of the contact pad 64 is recessed from what would have been the cylindrical outer surface 48 of the eccentric 22, as illustrated by the dashed lines in FIG. 10. As illustrated, a portion of the eccentric 22 removed to form the contact pad 64 such that the contact surface 70 is recessed from what would have been the outer surface 48. In the embodiment illustrated in FIG. 10, the distance the contact surface 70 is recessed from what would have been the outer surface 48 increases from the first end 50 of the eccentric to a termination point 72. Thus, the depth of the contact pad 64 increases from the termination point 72 to the first end 50 of the eccentric 22. In the embodiment illustrated in FIG. 10, the length of the contact pad 64 from the first end 50 to the termination point 72 is approximately one-half the total length of the lower head bushing 44. However, it is contemplated that the length of the contact pad 64 could be varied from approximately 12% of the length of the lower head bushing 44 to 100% of the length of the lower head bushing while operating within the scope of the present disclosure.

As illustrated in FIG. 11, the contact pad 64 is centered along a line of symmetry 74 that extends through the eccentric 22. As described previously, the contact pad 64 extends from the first end 50 to the uppermost termination point 72. In the embodiment shown in FIG. 11, contact pad 64 is formed as a cylindrical surface removed form the eccentric 22 such that the edge surface 66 has a generally elliptical configuration approaching that of a circle.

Figure 12:
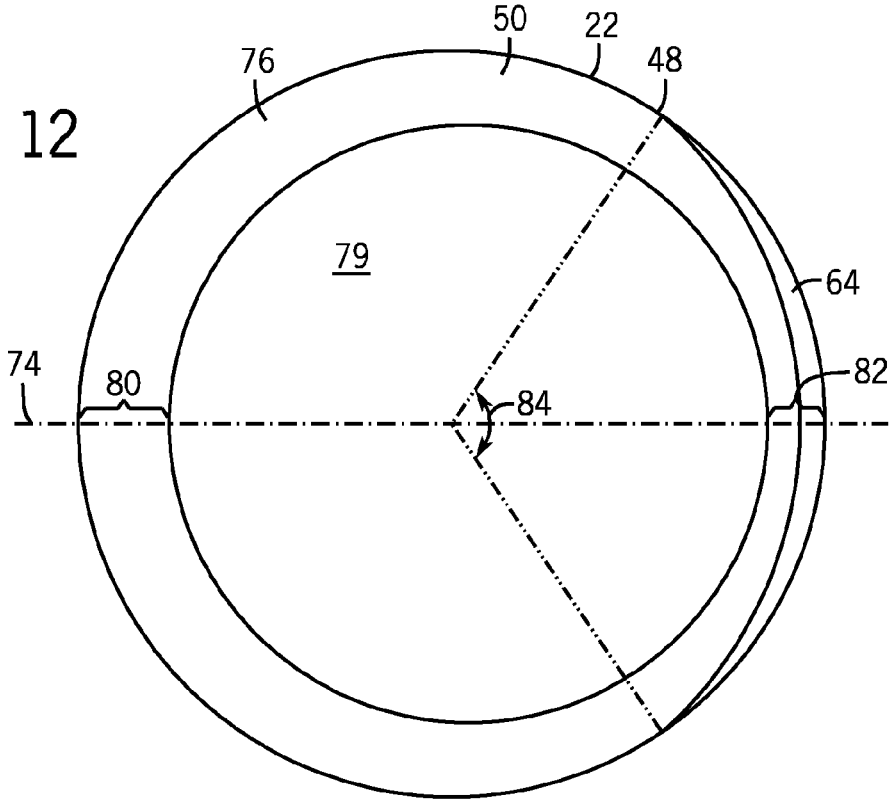
FIG. 12 is an end view taken along line 12-12 of FIG. 8 illustrating the contact pad formed on the eccentric.

Referring now to FIG. 12, thereshown is a bottom view of the eccentric 22 including the contact pad 64 of the present disclosure. The line of symmetry 74 bisects the eccentric 22. The eccentric 22, as is conventional, is formed by an outer wall 76 defined between the outer surface 48 and the generally cylindrical inner surface 78. The central bore 79 is offset from the center axis of the eccentric. Thus, the thickness of the outer wall 76 varies from a maximum thickness 80 to a minimum thickness 82. The variation in the outer wall thickness 78 creates the gyrational movement of the head assembly during rotation of the eccentric about the fixed main shaft, as was described previously.

As can be seen in FIG. 12, the contact pad extends across a maximum angle 84 at the first end 50 of the eccentric 22. As illustrated in the section view of FIG. 13 taken at a point between the first end 50 and the termination point 72, the angle 86 is less than the maximum angle 84 and the depth of the contact pad 64 is reduced relative to the depth of the contact pad shown in FIG. 12.

Figure 13:
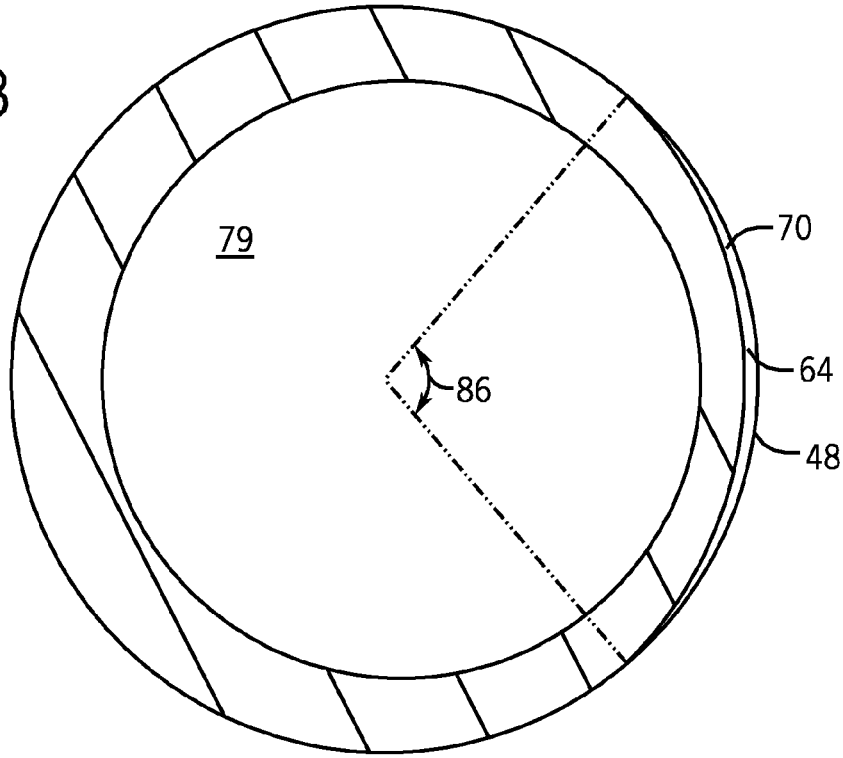
FIG. 13 is a section view taken along line 13-13 of FIG. 8 illustrating the recessed contact pad formed on the eccentric.

In the drawing illustrations of FIGS. 12 and 13, the depth of the contact pad from the outer surface 48 is exaggerated for illustrative purposes. In one illustrated embodiment of an eccentric formed with the contact pad 64, the height of the cylindrical portion of the eccentric 22 from the first end 50 to the second end 52 is approximately 630 mm. The diameter of the outer surface 48 of the eccentric is 999.96 mm. The inner diameter of the lower head bushing, which is defined by the inner surface 54, is 1002.45 mm. The difference between the inner diameter of the lower head bushing and the outer diameter of the eccentric creates the spacing between these two components. In the embodiment shown in FIG. 12, the contact angle 84 is 112.8° and the maximum depth of the contact pad at the first end 50 is 0.488 mm. The height of the contact pad from the first end 50 to the termination point 72 is 292.7 mm.

Although specific dimensions are set forth above, it should be understood that these dimensions are for illustrative purposes only and are not meant to limit the scope of the present disclosure. Specifically, the size of the eccentric 22 could vary, which would result in various different measurements for the contact pad 64.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A cone crusher comprising:

a frame;

a bowl coupled to the frame for receiving a supply of material to be crushed;

a bowl liner formed on the bowl to define one-half of a crushing gap;

a crusher head assembly spaced from the bowl liner to define a second half of the crushing gap;

an eccentric positioned to rotate about a fixed mounting shaft;

a lower head bushing included in the crusher head assembly and surrounding the eccentric such that during rotation of the eccentric about the center shaft, the eccentric contacts the lower head bushing to move the crusher head toward and away from the bowl liner to create a crushing force within the crushing gap; and a contact pad recessed from an outer surface of the eccentric, wherein when the cone crusher operates without any material, the lower head bushing engages the contact pad formed on the eccentric.

2. The cone crusher of claim 1 wherein the lower head bushing contacts the outer surface of the eccentric during the crushing operation with material in the crushing gap.

3. The cone crusher of claim 1 wherein the eccentric extends from a first end to a second end, wherein the contact pad extends from the first end of the eccentric to a termination point spaced from the second end of the eccentric.

4. The cone crusher of claim 3 wherein the circumferential length of the contact pad decreases from the first end of the eccentric to the termination point.

5. The cone crusher of claim 3 wherein the recessed depth of the contact pad from the outer surface of the eccentric increases from the termination point to the first end of the eccentric.

6. The cone crusher of claim 3 wherein the contact pad is cylindrical.

7. The cone crusher of claim 3 wherein the contact pad includes a contact surface recessed from the outer surface of the eccentric, wherein the recessed depth of the contact surface from the outer surface of the eccentric increases from the termination point to the first end of the eccentric.

8. The cone crusher of claim 7 wherein the contact surface is cylindrical.

9. The cone crusher of claim 1 wherein the eccentric is symmetrical about a line of symmetry, wherein the contact pad is centered about the line of symmetry.

10. The cone crusher of claim 9 wherein the eccentric has a wall thickness defined by the inner surface and the outer surface, wherein the wall thickness increases from a minimum thickness to a maximum thickness, wherein the minimum thickness and the maximum thickness are contained along the line of symmetry, wherein the contact pad is formed in the minimum thickness of the eccentric.

11. The cone crusher of claim 1 wherein the lower head bushing has a constant inner diameter from a first end to a second end.

* * * * *